United States Patent [19]

Tallis, Jr.

[11] Patent Number: 4,843,897

[45] Date of Patent: Jul. 4, 1989

[54] ENGINE STARTER GEARING

[75] Inventor: John R. Tallis, Jr., Horseheads, N.Y.

[73] Assignee: Facet Enterprises, Inc., Tulsa, Okla.

[21] Appl. No.: 140,600

[22] Filed: Jan. 4, 1988

[51] Int. Cl.[4] ..... F02N 11/00

[52] U.S. Cl. ..... 74/6; 74/7 A; 192/103 A; 192/114 R

[58] Field of Search ..... 74/3, 6, 7 A, 7 C, 7 R, 74/9; 192/103 A, 105 B, 114 R; 403/371, 372

[56] References Cited

U.S. PATENT DOCUMENTS

| | | | |
|---|---|---|---|
| 2,886,354 | 5/1959 | Björklund | 403/372 |
| 3,009,747 | 11/1961 | Pitzer | 403/371 |
| 3,263,509 | 8/1966 | Digby | 74/6 |
| 4,322,985 | 4/1982 | Mortensen | 74/6 |
| 4,611,499 | 9/1986 | Giometti | 74/6 |
| 4,712,435 | 12/1987 | Losey et al. | 74/7 A |
| 4,715,239 | 12/1987 | Giometti | 74/7 A |

*Primary Examiner*—Allan D. Herrmann
*Assistant Examiner*—Janice Chartoff
*Attorney, Agent, or Firm*—James R. Ignatowski; Remy J. VanOphem

[57] ABSTRACT

Centrifugally disengageable engine starter gearing for selectively starting an engine having a starting gear. The engine starter gearing includes a power shaft, a sleeve slidably secured to the power shaft, a pinion gear slidably mounted to the power shaft and movable into engagement with the starting gear, a driven clutch member secured to the pinion gear and having splines on a generally circular interior recess therein, a flyweight retainer having splines thereon engaging the splines on the generally circular interior recess, a driving clutch member mounted to the sleeve, mutually engageable clutch teeth on the driving and driven clutch members, a housing fitted over the driving and driven clutch members, an abutment confining the driving and driven clutch members within the housing, a resilient member biasing the driving and driven clutch members into mutual engagement, a radially inwardly extending shoulder on the driving clutch member adjacent the circular recess, and an annular thrust washer having an inner conical surface, the annular thrust washer abutting a loose washer which, in turn, abuts the radially inwardly extending shoulder of the driving clutch member. A plurality of unitary centrifugal flyweight members are annularly arranged in cavities formed in the flyweight retainer. Each centrifugal flyweight member has an inclined surface abutting the conical surface of the thrust washer and is operative to displace the thrust washer in the first axial direction in response to centrifugal force. The cavities in the flyweight retainer extend radially outwardly and cooperate with at least a portion of each of the centrifugal flyweight members to prevent circumferential movement of the plurality of centrifugal flyweight members while permitting radial movement thereof.

16 Claims, 3 Drawing Sheets

ENGINE STARTER GEARING

BACKGROUND OF THE INVENTION

1. Field of the Invention

The present invention relates to engine starter gearing for an engine and more particularly to engine starter gearing of a positive shift type, including a dentil clutch to provide driving and overrunning features and further including provisions for effecting the automatic separation of the clutch teeth after the engine becomes self-running.

2. Description of the Prior Art

The present invention is an improvement over U.S. Pat. No. 4,712,435, entitled "Engine Starter Gearing," issued Dec. 15, 1987, to Losey et al and assigned to the assignee hereof, as well as a further improvement over the starter gearing system described in U.S Pat. No. 3,263,509 entitled "Engine Starter Drive" and issued Aug. 2, 1966, to James Digby. The Digby patent disclosed an engine starter gearing using centrifugal weights and a conical thrust washer for separating dentil clutch teeth after engine start-up to prevent long periods of clutch overrunning and accompanying deleterious wear on the clutch teeth. An annular recess is formed in the driven clutch member. A circular recess is provided in the face of the driven clutch member facing the driving clutch member. An annular thrust washer is fitted in the recess and abuts the driving clutch member. A conical surface is provided in the annular thrust washer facing the driven clutch member. A plurality of centrifugal flyweight members are also provided in the circular recess. The centrifugal flyweight members are provided with an inclined surface cooperating with the conical surface in the annular thrust washer, such that, when an overrunning condition occurs, the centrifugal flyweight members move outwardly and the inclined surface engages the conical surface of the annular thrust washer so as to bias the driving clutch member away from the driven clutch member. The centrifugal flyweight members are prevented from axial or rotational movement with respect to the driven clutch member by pins extending through suitable bores in the driven clutch member and the centrifugal flyweight member.

While the engine starter gearing of Digby has been satisfactory in operation, it is difficult and expensive to assemble. This is true because a plurality of movable pins and centrifugal flyweight members must be somehow maintained in position relative to the driven clutch member during the assembly of the driven clutch member to the driving clutch member. Furthermore, the weight and, therefore, the effectiveness of the centrifugal flyweight members is reduced by the existence of a substantial bore therethrough, in comparison to the size of the centrifugal flyweight member, for admission of the pin. The bore through the centrifugal flyweight members further reduces the strength of the flyweight members and, accordingly, limits the materials and dimensions which may advantageously be used for the centrifugal flyweight members.

The embodiment of FIGS. 3 and 4 of the aforesaid U.S. Pat. No. 4,712,435, entitled "Engine Starter Gearing," issued Dec. 15, 1987, to Losey et al solved many of the aforesaid engine starter gearing disadvantages, but such embodiment requires the use of a driven clutch member which is difficult to machine.

What is needed, therefore, is an improved engine starter gearing using a centrifugal flyweight clutch separator which is easier and less expensive to assemble. Furthermore, what is needed is such an engine starter gearing having a more solid, compact, and durable configuration for the centrifugal flyweight member, which simplifies the manufacturing operations involved in manufacturing such engine starter gearing, particularly in regard to the driven clutch member component thereof.

SUMMARY OF THE PRESENT INVENTION

The present invention provides a novel and improved engine starter gearing. The engine starter gearing of the present invention provides a centrifugal weight clutch separator using solid unitary centrifugal flyweight members which facilitates the manufacture of the flyweight members and the assembly of the flyweight members to the engine starter gearing.

In particular, the engine starter gearing of the present invention provides a power shaft, a sleeve slidably secured to the power shaft, and helical splines on one extremity of the sleeve. A pinion gear is slidably journalled to the power shaft for axial movement relative thereto, the pinion gear being structured for movement into and out of engagement with the starting gear of the engine to be started. A driven clutch member is secured to the pinion gear for movement therewith. A circular recess is located in the driven clutch member. A driving clutch member is slidably mounted on the helical splines of the sleeve. The driving and driven clutch members have complementary mutually engageable inclined teeth for transmitting torque therebetween in one direction of relative rotation.

A barrel housing is slidably supported on the sleeve and is provided with an open end such that the barrel housing may be fitted over the driving and driven clutch members. The driving and driven clutch members are contained within the barrel housing by abutment means. A resilient member is disposed within the barrel housing and abuts the driving clutch member so as to bias the driving and driven clutch members into mutual engagement. A radially inwardly extending shoulder is formed on the driving clutch member adjacent the recess formed in the driven clutch member. An annular thrust ring having an inner conical surface is loosely disposed in the circular recess in the driven clutch member. The annular thrust ring is structured to abut the radially inwardly extending shoulder of the driving clutch member when displaced in a first direction.

A plurality of centrifugal flyweight members are annularly arranged in the circular recess in the driven clutch member. The plurality of centrifugal flyweight members each have an inclined surface abutting the conical surface of the thrust ring. The plurality of centrifugal flyweight members are operative to displace the thrust ring in a first axial direction in response to centrifugal force. A plurality of cavities are formed in a molded plastic sleeve which is inserted into the circular recess of the driven clutch member. Each of the cavities slidably receives at least a portion of an associated centrifugal flyweight member of the plurality of centrifugal flyweight members to prevent its circumferential movement while permitting radial movement thereof.

In the preferred embodiment of the present invention, the driven clutch member is provided with a plurality of splines along the circular recess in the driven clutch member which engage corresponding splines in the outside of the plastic sleeve for positioning the sleeve relative to the driven clutch member. Each of the flyweight members includes a portion extending longitudinally from the inclined surface toward the interior of the plastic sleeve member.

The primary object of the present invention is to provide an engine starter gearing which is easy to assemble. The present invention accomplishes this object by providing a plurality of unitary centrifugal flyweight members each directly engageable with a plastic sleeve within the driven clutch member so as to reduce the number of components which must be secured together during assembly and reduce the complexity of the fabricating steps that must be followed to properly manufacture such components. Particularly, because the driven clutch member of the present invention secures the plastic sleeve thereto by engagement of splines, the splines can be rolled on as part of the present machining process. This serves to eliminate tooling and manufacturing expenses inherent in the machining process described in the aforesaid Pat. No. 4,712,435.

Another object of the present invention is to provide engine starter gearing having a centrifugal flyweight clutch separator with strong centrifugal flyweight members. The present invention satisfies this object by providing unitary flyweight members without cavities formed therein, such that the flyweight members may be formed of a wide variety of available materials.

These and many other objects, features and advantages of the present invention will become apparent to those skilled in the art when the following detailed description of the preferred embodiment is read together with the drawings and claims appended hereto.

DETAILED DESCRIPTION OF THE PREFERRED EMBODIMENT

Figure 1:
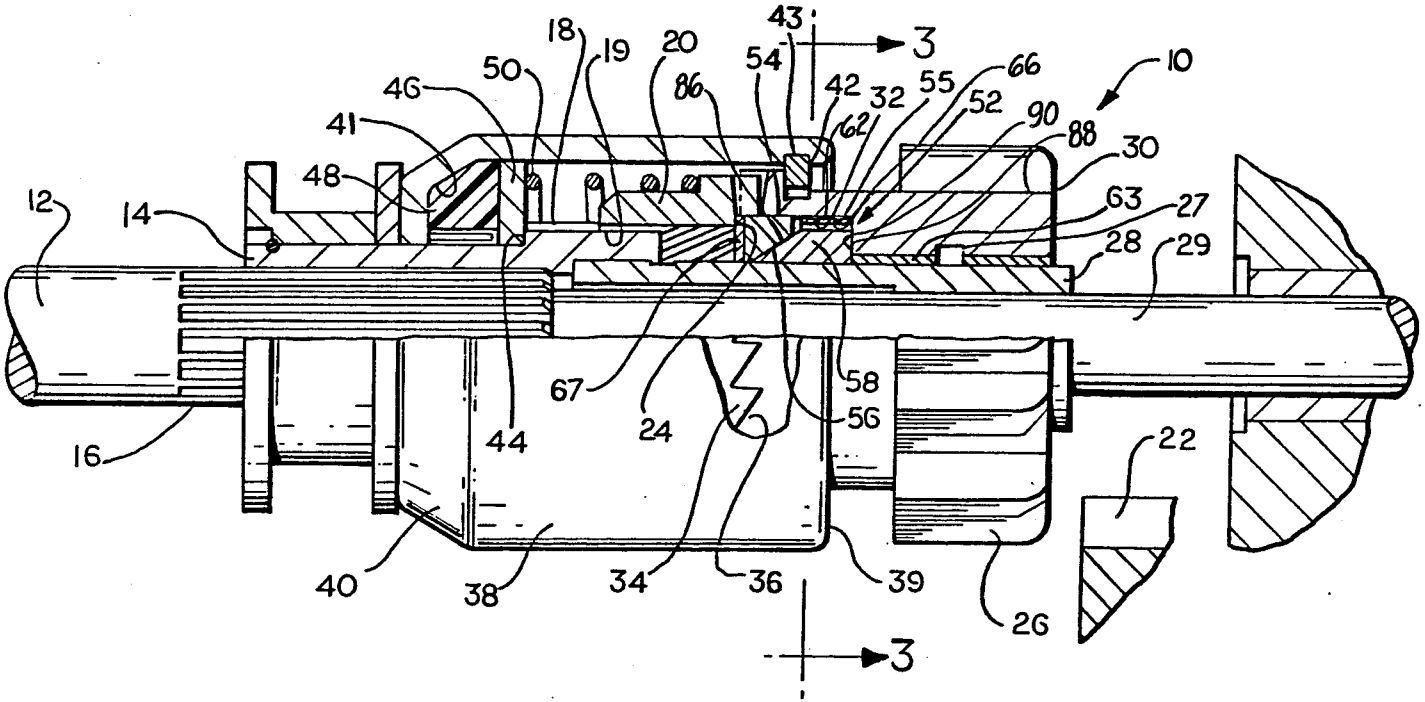
FIG. 1 is a side elevational view, partly broken away and partly in section, of the preferred embodiment of structure for an engine starter gearing according to the present invention.

Referring now to the drawing and more particularly to FIG. 1 thereof, there is illustrated a starter drive 10 for an engine, not shown, mounted to a power shaft 12 of a starting motor, also not shown. The starter drive 10 includes an axially extending sleeve 14 connected to the power shaft 12 by straight splines 16. The axially extending sleeve 14 is, therefore, axially movable relative to the power shaft 12 but may not rotate relative thereto. The external surface of the righthand extremity of the axially extending sleeve 14, as illustrated, has external helical splines 18 formed thereon. A driving clutch member 20 has internal helical splines 19 threaded onto the external helical splines 18 of the axially extending sleeve 14. The driving clutch member 20 is, therefore, adapted for movement towards and away from a starting gear 22 of the engine to be started. The driving clutch member 20 is illustrated in its engaged position in the drawing. In the engaged position, the driving clutch member 20 projects past he right end of the axially extending sleeve 14. The rightmost edge, as illustrated, of the internal helical splines 19 of the driving clutch member 20 forms a radially inwardly extending shoulder 24, for a purpose to be described later.

A sleeve 28 is slidably supported on a reduced diameter portion 29 of the power shaft 12. One end of the sleeve 28 is secured to the axially extending sleeve 14. A pinion gear 26 is journalled on a bearing 63 which is press fit into the pinion gear 26. A lubrication groove 27 is located between the sleeve 28 and the bearing 63. The bearing 63, in turn, is slidably mounted on the sleeve 28 thereby permitting the pinion gear 26 to be axially and rotatably movable relative to the power shaft 12. The pinion gear 26 is structured for movement into and out of engagement with the starting gear 22 of the engine to be started. A driven clutch member 30 is integrally formed with the pinion gear 26 and extends therefrom towards the driving clutch member 20. An internal circular recess 32 is provided in the driven clutch member 30 adjacent the driving clutch member 20. The internal circular recess 32 cooperates with the sleeve 28 to define an annular channel therebetween.

The adjacent faces of the driving clutch member 20 and driven clutch member 30 are provided with dentil teeth 34 and 36, respectively, which are complementary mutually engageable inclined torque transmitting dentil teeth. The dentil teeth 34 and 36 are of the sawtooth variety to provide a one-way overrunning clutch connection.

A housing 38 having an open end 39 and a closed end 40 is slidably supported at its closed end 40 on an external surface of the axially extending sleeve 14. The housing 38 is barrel-shaped and fitted over the driving clutch member 20 and partially over the driven clutch member 30. A lock ring 42 is seated in a groove 43 adjacent the open end 39 of the housing 38. The lock ring 42 has sufficient radial length to engage the driven clutch member 30 to thereby confine the driven clutch member 30 and the driving clutch member 20 within a cavity 41 of the housing 38.

The axially extending sleeve 14 is provided with a radial shoulder 44 in an intermediate location therealong to provide an abutment for a disk or washer 46 slidably journalled on the axially extending sleeve. A resiliently yieldable annular member 48, preferably formed of an elastically deformable material, such as rubber, is compressively confined between the washer 46 and the closed end 40 of the housing 38. A resilient spring member 50 is compressively confined within the cavity 41 of the housing 38 between the washer 46 and the driving clutch member 20 to provide a biasing force urging the driving clutch member 20 into engagement with the driven clutch member 30.

An advancement apparatus, not illustrated in the drawing but well known in the art, is provided for moving the starter drive 10 towards and away from the starting gear 22 of the engine.

Figure 2:
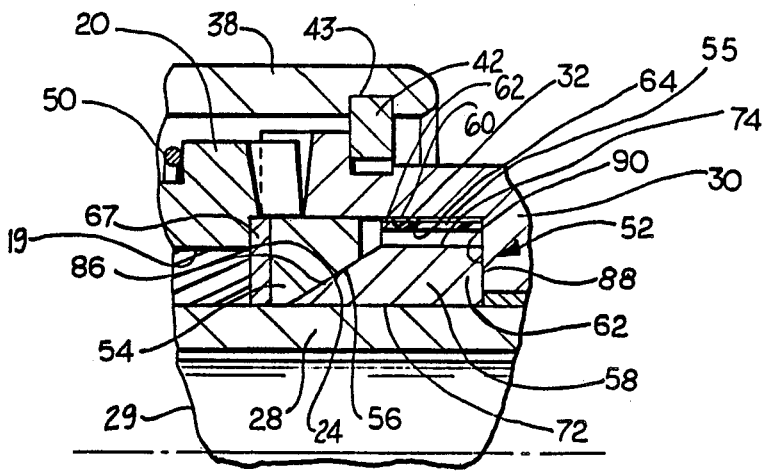
FIG. 2 is an enlarged fragmentary view of the engine starter gearing shown in FIG. 1.
Figure 3:
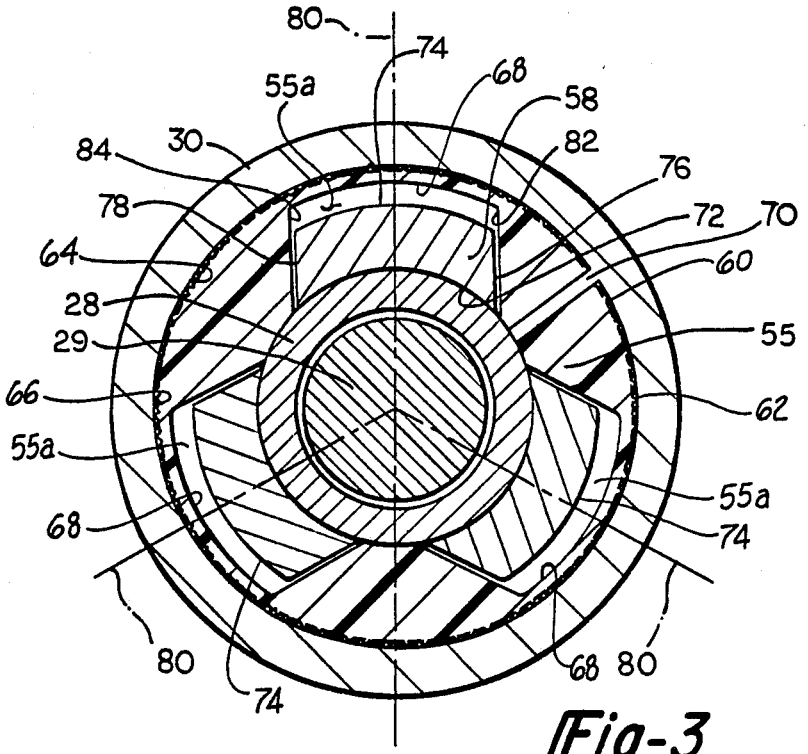
FIG. 3 is a cross-sectional view taken along lines 3—3 of FIG. 1 at a somewhat enlarged scale relative to that of FIG. 1.
Figure 5:
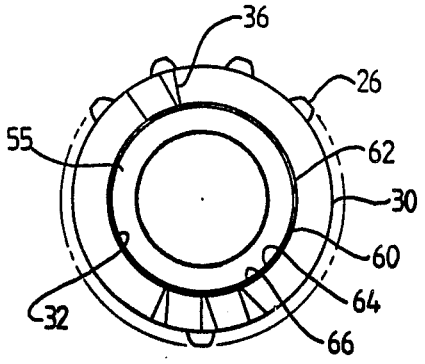
FIG. 5 is an end view of the driven clutch along lines 5—5 of FIG. 4.

The starter drive 10 is provided with a centrifugal flyweight clutch separator assembly, generally indicated by reference numeral 52, to effect disengagement of the driving clutch member 20 from the driven clutch member 30 when the engine is running above a predetermined speed. The separator assembly thereby avoids excessive wear of the mutually engaging dentil clutch teeth 34 and 36. The centrifugal flyweight clutch separator assembly 52 includes an annular thrust washer 54 disposed within the internal recess 32. Located between the annular thrust washer 54 and the annular shoulder 24 of the driving clutch member 20 is a loose thrust washer 67. A sleeve-like flyweight retainer 55 is also retained in the internal circular recess 32, forwardly of the annular thrust washer 54. It is preferred that the flyweight retainer be constructed of molded plastic. As seen in FIGS. 2 and 3, an outer surface 60 of the flyweight retainer 55 is provided with a circumferential plurality of splines 62 which engage a complementary circumferential plurality of splines 66 on an inside surface 64 of the driven clutch member 30 to accurately circumferentially orient and retain the flyweight retainer 55 with respect to the driven clutch member 30. The flyweight retainer 55 also is provided on its inside surface with a circumferential series of spaced-apart recesses 55a, as is shown in FIG. 3.

Figure 4:
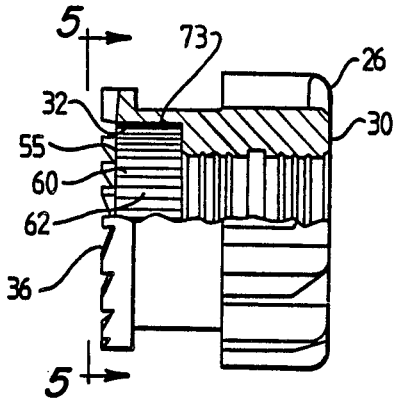
FIG. 4 is a side elevational view, partly in section of the driven clutch member according to the present invention.

As can be seen from FIG. 4, the splines 66 formed on the inside surface 64 of the drive clutch member 30 are located adjacent the dentil teeth 36. The inside surface 64 is generally circular and the splines 66 are preferably formed thereinto as shallow splines similar to a serrated or knurled surface.

Figure 6:
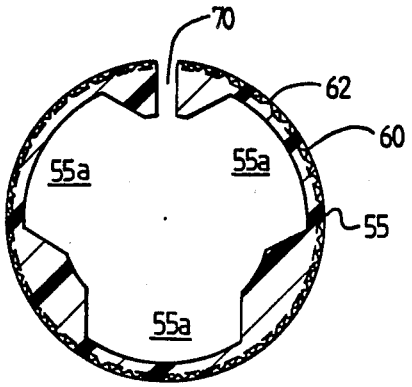
FIG. 6 is a cross-sectional end view of the flyweight retainer according to the present invention.
Figure 7:
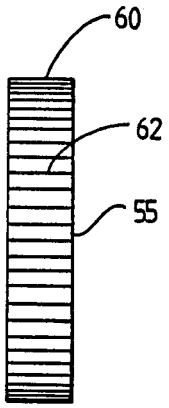
FIG. 7 is a side view of the flyweight retainer of FIG. 6.

The flyweight retainer 55 is annularly dimensioned to insert into the internal circular recess 32 of the driven clutch member 30 so that the outer surface 60 of the flyweight retainer 55 abuts the inside surface 64 of the driven clutch member 30. As can be seen from FIG. 6, the plurality of splines 62 are provided on the outer surface 60 of the flyweight retainer 55. These splines are complementary to the splines 66 on the inside surface of the driven clutch member and are preferably formed as shallow splines similar to a serrated or knurled surface. In order that the flyweight retainer 55 be insertable into the internal circular recess 32 of the driven clutch member 30 and located against a base surface 90, and yet be of sufficient cross-section so that its splines 62 may engage the splines 66 on the inside surface of the driven clutch member, the flyweight retainer 55 is provided with a slot 70 which permits it to be deformed during insertion into the driven clutch member. The slot 70 is located between the spaced apart recesses **55*a*, as shown in FIG. 6. The flyweight retainer 55** is made of a structurally strong yet resilient material, such as a structural plastic, which permits deformation sufficient to seat the flyweight retainer within the driven clutch member and resume its original shape once it is seated therein.

In the preferred embodiment of the present invention, the splines 66 on the inside surface 64 of the driven clutch member 30 are located in a central portion 73 of the inside surface of the internal circular recess 32. Accordingly, once the flyweight retainer 55 is seated within the internal circular recess 32 against the base surface 90, the engagement of the splines 62 and 66 will cause the flyweight retainer to be retained within the driven clutch member.

A plurality of centrifugal flyweight members 58 are fitted in the spaced-apart recesses **55*a* of the flyweight retainer 55. A portion of each of the centrifugal flyweight members 58 extends into one of the spaced-apart recesses 55*a*. In fact, the major portion of each of the centrifugal flyweight members 58 is disposed within each of the spaced-apart recesses 55*a***.

As can be seen from FIGS. 2 and 3, each of the centrifugal flyweight members 58 is appropriately dimensioned for cooperation with the spaced-apart recess **55*a* in which it is located and a conical inner surface 56 of the annular thrust washer 54. The spaced-apart recess has an inside surface 68 which is spaced from the centrifugal flyweight member so that the centrifugal flyweight member can reciprocate radially, as will be explained below. Thus, each of the centrifugal flyweight members 58 has an inner surface 72 engaging the outer surface of the sleeve 28 and an outer surface 74 remote from the inner surface. Preferably, the inner surface 72 and the outer surface 74 are circular, cylindrically shaped, and concentric. A first and second guide surface 76 and 78, respectively, are formed between the inner surface 72 and the outer surface 74 of each of the centrifugal flyweight members 58. The first and second guide surfaces 76 and 78 are flat and parallel to each other. Preferably, they are parallel to the radial plane 80 through the center of gravity of the centrifugal flyweight members. The first and second guide surfaces 76 and 78 cooperate with first and second parallel surfaces 82 and 84 of the recesses 55*a* of the annular flyweight retainer to guide the reciprocal motion of the centrifugal flyweight members 58** without permitting substantial motion in either the axial or circumferential direction.

Each of the centrifugal flyweight members 58 is also provided with an inclined surface 86 extending inwardly and angularly away from the outer surface 74 towards the inner surface 72 thereof. The inclined surface 86 cooperates with the conical inner surface 56 of the annular thrust washer 54 to separate the dentil teeth 34 and 36, respectively, of the driving clutch member 20 and the driven clutch member 30 during an overrunning condition. The centrifugal flyweight members 58 are also provided with a third guide surface 88 disposed remote from the inclined surface 86 and extending perpendicular to each of the first and second guide surfaces 76 and 78 between the inner surface 72 and the outer surface 74. The third guide surface 88 cooperates with the base surface 90 of the internal recess circular 32. The base surface 90, therefore, acts as an abutment during the radial outward motion of the centrifugal flyweight member 58.

In operation, when it is desired to crank the engine, the starter drive 10 is shifted to the right via the shifting mechanism, not illustrated, so that the pinion gear 26 engages the starting gear 22. The power shaft 12 is rotated by a starting motor, not illustrated, and transmits torque through the straight splines 16 to the axially extending sleeve 14, and from the helical splines 18 to the driving clutch member 20. The driving clutch member 20 drives the driven clutch member 30 through the dentil teeth 34 and 36. The driven clutch member 30 thereby rotates the pinion gear 26 and the starting gear 22 of the engine.

As the engine fires and becomes self-operating, the starting gear 22 will drive the pinion gear 26 at a speed greater than that of the power shaft 12. The dentil teeth 34 and 36 will slip so that the starting motor is not driven at a high engine speed. In order to protect the dentil teeth 34 and 36 from severe wear due to the rubbing and clashing which would otherwise occur, and further to avoid unnecessary noise, the rapid rotation of the driven clutch member 30 drives the centrifugal flyweight members 58 radially outwardly. The movement of each centrifugal flyweight member 58 is guided by one of the recesses 55*a* of the annular flyweight retainer so as to prevent any motion of the centrifugal flyweight members 58 relative to the driven clutch member 30 other than the desired radial motion.

The outward motion of the centrifugal flyweight members 58 will bring the inclined surface 86 of the centrifugal flyweight members 58 into engagement with the conical inner surface 56 of the annular thrust washer 54, urging the annular thrust washer 54 to the left against the biasing force of the resilient spring member 50, as illustrated in FIG. 1. This motion of the annular thrust washer 54 is transferred through the loose thrust washer 67 to the radially inwardly extending shoulder 24 of the driving clutch member 20, causing a separation between the driving clutch member 20 and the driven clutch member 30.

The starter drive 10 disclosed above has certain additional advantages over the prior art. It will be readily appreciated by those skilled in the art that the centrifugal flyweight members 58 are extremely easy and inexpensive to form, as compared with prior art centrifugal flyweight members for starter drive gearing. Furthermore, the centrifugal flyweight members 58 are very strong and may be formed from materials which might even be inappropriate for the centrifugal flyweight members 58 described previously, thereby further increasing the number of materials which may be selected from for manufacturing this component. Furthermore, precise dimensions may be provided in the recesses that are used to retain the flyweights through the use of a molded plastic flyweight retainer 55 containing the recesses 55*a*, which thereby eliminates the need to resort to complex machining or cold-forming operations in an effort to form such precisely dimensioned recesses directly in the driven clutch member 30, which is normally formed from a hard metal because of the loads and wear that it is subjected to in normal service. Importantly, because complementary splines are provided on both the outer surface of the flyweight retainer and the inside surface of the driven clutch member, there is no need to further machine the driven clutch member in order to provide for holding of the flyweight retainer; the splines may be rolled on during the machining process without requiring special tools or manufacturing processes. The flyweight retainer 55 is preferably formed from a hard, dimensionally resilient and stable thermoplastic material, such as a Nylon (polyamide) based material, and the flyweight retainers may be readily and inexpensively mass-produced from such a thermoplastic material by conventional injection molding practices and equipments.

The above constitutes a detailed description of the best mode contemplat at the time of filing for carrying out the present invention. It will be apparent to those skilled in the art that many variations and modifi may be made form the above described examples without departing from the spirit of the present invention. Such variations and modifications are included within the intended scope of the claims appended hereto.

What is claimed is:

1. An engine starter gearing for selectively starting an engine having a starting gear, said engine starter gearing comprising:

a power shaft;

a sleeve slidably, but non-rotatably, secured to said power shaft, said sleeve having external helical splines formed on one extremity thereof;

a pinion gear slidably journalled to said power shaft for axial movement relative thereto, said pinion gear being structure for movement into and out of engagement with said starting gear of said engine to be started;

a driven clutch member secured to said pinion gear for movement therewith; said driven clutch member having a circular internal recess formed therein, said circular internal recess having an inside surface, said inside surface having splines formed therein, said circular internal recess terminating inwardly in a base surface perpendicular to said inside surface;

a flyweight retainer seated within said circular internal recess formed in said driven clutch member, said flyweight retainer having an exterior surface and an interior surface, said exterior surface of said flyweight retainer having splines formed therein, said splines on said inside surface of said circular internal recess of said driven clutch member engaging said splines on said exterior surface of said flyweight retainer, said interior surface having a plurality of cavities;

a driving clutch member slidably mounted on said helical splines of said sleeve, said driving and driven clutch members having complementary mutually engageable inclined teeth for transmitting torque therebetween in one direction of rotation;

a housing having an open end, said housing being slidably supported on said sleeve and spatially encompassing said driving and driven clutch members;

abutment means disposed within said housing adjacent said open end thereof, said abutment means being structured for engagement with said driven clutch member for confining said driving and driven clutch member within said housing;

resilient means disposed within said housing, said resilient means abutting said driving clutch member, said resilient means further biasing said driving and driven clutch members into mutual engagement;

a radially inwardly extending shoulder formed on said driving clutch member adjacent said circular internal recess of said driven clutch member;

an annular thrust washer loosely disposed in said circular internal recess of said driven clutch member, said annular thrust washer having an inner conical surface, said annular thrust washer being structured to abut said radially inwardly extending shoulder of said driving clutch member when said annular thrust washer is displaced in a first axial direction; and a plurality of centrifugal flyweight members annularly arranged within said flyweight retainer, each centrifugal flyweight member of said plurality of centrifugal flyweight members having an inclined surface abutting said inner conical surface of said annular thrust washer, said plurality of centrifugal flyweight members being operative to displace said annular thrust washer in said first axial direction in response to centrifugal force;

each cavity of said plurality of cavities slidably receiving at least a portion of a respective centrifugal flyweight member of said plurality of centrifugal flyweight members to prevent circumferential movement of said plurality of centrifugal flyweight members while permitting radial movement thereof.

2. The engine starter gearing of claim 1 wherein said at least a portion of said respective centrifugal flyweight member disposed in each said cavity is substantially axially aligned with the center of gravity of said respective centrifugal flyweight member.

3. The engine starter gearing of claim 1 wherein said flyweight retainer is made of dimensionally resilient and stable thermoplastic material.

4. The engine starter gearing of claim 3 wherein said splines formed in said inside surface of said circular internal recess of said driven clutch member are present only in a central portion of said inside surface of said circular internal recess.

5. The engine starter gearing of claim 4 wherein said flyweight retainer has a slot for permitting dimensional deformation of said flyweight retainer so that said flyweight retainer may be seated within said circular internal recess of said driven clutch member.

6. The engine starter gearing of claim 5 wherein said splines formed in said inside surface of said circular internal recess form a serrated surface; and said splines formed in said exterior surface of said flyweight retainer form a serrated surface.

7. The engine starter gearing of claim 1 further comprising stop means movable with said pinion gear and said driven clutch member to provide a radially inward abutment stop for said plurality of centrifugal flyweight members.

8. The engine starter gearing of claim 1 wherein said plurality of centrifugal flyweight members comprises three centrifugal flyweight members and said plurality of cavities comprises three cavities.

9. The engine starter gearing of claim 1 wherein each of said plurality of centrifugal flyweight members coprises a unitary member comprising:

an inner surface disposed adjacent said sleeve, said inner surface having a partial circular cylindrical shape;

an outer surface disposed remote from said inner surface;

a first guiding surface extending between said inner surface and said outer surface, said first guiding surface being flat, said first guiding surface being adjacent one surface of one of said plurality of cavities formed in said interior surface of said flyweight retainer;

a second guiding surface extending between said inner surface and said outer surface, said second guiding surface being flat and parallel to said first guiding surface, said second guiding surface being adjacent another surface of one of said plurality of cavities formed in said interior surface of said flyweight retainer; said inclined surface being formed between said outer surface and said inner surface and between said first and second guiding surfaces; and a third guiding surface extending between said inner surface and said outer surface remote from said inclined surface, said third guiding surface being perpendicular to each of said first and second guiding surfaces and extending therebetween, said third guiding surface being adjacent said base surface of said driven clutch member.

10. The engine starter gearing of claim 9 wherein said first and second guiding surfaces are parallel to the radial plane through the center of gravity of said centrifugal flyweight member.

11. The engine starter gearing of claim 10 wherein said outer surface has a partial circular cylindrical shape that is concentric with said inner surface.

12. In a centrifugally disengageable engine starter gearing for selectively starting an engine, the engine starter gearing having a power shaft, a sleeve slidably secured to said power shaft, a pinion gear slidably mounted to said power shaft and movable into engagement with said starting gear, a driven clutch member secured to said pinion gear and having an interior recess therein, a flyweight retainer having an inside and an outside surface, said inside surface of said flyweight retainer having a plurality of cavities, said flyweight retainer being seated in said interior recess, a plurality of flyweight member, each flyweight member of said plurality of flyweight members having aniinclined surface, said flyweight members being annularly arranged wherein one said flyweight member is in each cavity of said plurality of cavities in said flyweight retainer, a driving clutch member mounted to said sleeve, mutually engageable teeth on said driving and driven clutch members, a housing fitted over said driving and driven clutch member, an abutment confining said driving and driven clutch members within said housing, a resilient member biasing said driving and driven clutch members into mutual engagement a radially inwardly extending shoulder on said driving clutch member adjacent said interior recess, an annular thrust washer having an inner conical surface abutting said inclined surface of each of said plurality of flyweight members, said annular thrust washer abutting a loose washer which, in turn, abuts said radially inwardly extending shoulder of said driving clutch member, said plurality of cavities in said flyweight retainer cooperating with at least a portion of each of said plurality of flyweight members to prevent circumferential movement of said plurality of flyweight members while permitting radial movement thereof, the improvement comprising:

an inside surface on said internal recess of said driven clutch member;

a first plurality of spines on said inside surface of said interior recess of said driven clutch member, said interior recess being circular in shape; and a second plurality of splines on said outside surface of said flyweight retainer, said outside surface of said flyweight retainer being circular in shape, said first and second plurality of splines being in mutual engagement when said flyweight retainer is seated inside said drive clutch member.

13. The engine starter gearing of claim 12 wherein said flyweight retainer is made of dimensionally resilient and stable thermoplastic material.

14. The engine starter gearing of claim 13 wherein said splines formed in said inside surface of said internal recess of said driven clutch member are present only in a central portion of said inside surface.

15. The engine starter gearing of claim 14 wherein said flyweight retainer has a slot for permitting dimensional deformation of said flyweight retainer so that said flyweight retainer may be seated within said internal recess of said driven clutch member.

16. The engine starter gearing of claim 15 wherein said splines formed in said inside surface of said internal recess form a serrated surface; said splines formed in said outside surface of said flyweight retainer form a serrated surface.

* * * * *